US008215588B2

(12) United States Patent
Wrage et al.

(10) Patent No.: US 8,215,588 B2
(45) Date of Patent: Jul. 10, 2012

(54) STEERING UNIT FOR FREE FLYING, CONFINED WING ELEMENT

(75) Inventors: Stephan Wrage, Hamburg (DE); Stephan Brabeck, Hamburg (DE)

(73) Assignee: SkySails GmbH & Co. KG, Hamburg (DE)

( * ) Notice: Subject to any disclaimer, the term of this patent is extended or adjusted under 35 U.S.C. 154(b) by 533 days.

(21) Appl. No.: 12/377,848

(22) PCT Filed: Sep. 14, 2006

(86) PCT No.: PCT/EP2006/008959

§ 371 (c)(1), (2), (4) Date: Feb. 17, 2009

(87) PCT Pub. No.: WO2008/031446

PCT Pub. Date: Mar. 20, 2008

(65) Prior Publication Data

US 2010/0282153 A1 Nov. 11, 2010

(51) Int. Cl.
*B64C 31/06* (2006.01)

(52) U.S. Cl. ..... 244/155 A; 244/153 R; 244/142; 244/152; 244/902

(58) Field of Classification Search ..... 244/153 R, 244/155 A, 138 R, 142, 152, 145, 902
See application file for complete search history.

(56) References Cited

U.S. PATENT DOCUMENTS

| | | | | |
|---|---|---|---|---|
| 5,738,307 | A * | 4/1998 | Webb | 244/152 |
| 6,505,793 | B2 * | 1/2003 | Schwarzler | 244/142 |
| 6,514,115 | B2 * | 2/2003 | Harich | 446/34 |
| 6,877,697 | B2 * | 4/2005 | Bellacera | 244/155 A |

FOREIGN PATENT DOCUMENTS

| | | | |
|---|---|---|---|
| DE | 202004013841 | U1 | 2/2006 |
| DE | 102004054097 | A1 | 5/2006 |
| WO | WO 2005/100147 | A1 | 10/2005 |

OTHER PUBLICATIONS

Sep. 10, 2009 Examination Report from EP 06805716.5 (3 pages).

* cited by examiner

*Primary Examiner* — Timothy D Collins

*Assistant Examiner* — Jamie S Stehle

(74) *Attorney, Agent, or Firm* — Kilpatrick Townsend & Stockton LLP

(57) ABSTRACT

The invention relates to a steering unit for a wind propulsion system, the steering unit comprising a first fixed attachment means for securing a first end of a tractive cable the second end of which is secured to a device or a vehicle to which a tractive force shall be transferred, a second attachment means for attaching a number of tractive lines, the second end of which being secured to an aerodynamic wing element, a mechanical support frame connecting the first attachment means to the second attachment means for transferring a tractive force. The invention aims at providing such a steering unit with improved design for better maneuverability and stability. According to the invention the second attachment means of the improved steering unit comprise at least one upper fixed attachment point, a left moveable attachment point, a right moveable attachment point, and steering actuator means for varying the distance between the upper fixed attachment point and the left moveable attachment point and for varying the distance between the upper fixed attachment point and the right moveable attachment point.

23 Claims, 3 Drawing Sheets

STEERING UNIT FOR FREE FLYING, CONFINED WING ELEMENT

CROSS-REFERENCE TO RELATED APPLICATIONS

This application is a National Stage of International Application No. PCT/EP2006/008959, filed Sep. 14, 2006, the disclosure of which is incorporated herein by reference.

BACKGROUND AND SUMMARY

The invention relates to a steering unit for a wind propulsion system, the steering unit comprising a first fixed attachment means for securing a first end of a tractive cable the second end of which is secured to a device or a vehicle to which a tractive force shall be transferred, a second attachment means for attaching a first end of a number of tractive lines, the second end of which being secured to an aerodynamic wing element. A mechanical support frame connects the first attachment means to the second attachment means to transfer a tractive force. A further aspect of the invention is an aerodynamic wind propulsion system comprising such a steering unit. Still further, the invention relates to a method of controlling such an aerodynamic wind propulsion system.

A wind propulsion system according to the invention basically comprises an aerodynamic wing element which is connected to a steering unit in close proximity to the wing element via a number of tractive lines. The steering unit itself is connected via a single tractive cable to a vehicle or an energy converter, to which the tractive force generated by the aerodynamic wing element shall be transferred.

Examples of such wind propulsion systems are disclosed in WO2005/100150 and WO2005/100147.

In order to broaden the field of application and the efficiency of such wind propulsion systems it is generally desired, to enlarge the size of the aerodynamic wing element. When aiming to provide an efficient wind propulsion system which may for example be used to tow cargo ships it is necessary that the aerodynamic wing element, such as a kite, has an area of 160 to 5000 $m^2$. A general problem associated with such large scale wing elements is the control of their flight. Moreover, since it is desired that the wing element flies at a high altitude in order to use the increased wind speed present there, it is not efficient to connect the wing element to the ground attachment point via more than one tractive line since this would increase the weight of the attachment means. Thus, it is necessary to connect the wing element via a number of tractive lines to a gondola which is arranged close to the wing element, whereas the gondola itself is connected to a base attachment point on the ground or a vessel via one single tractive cable.

When selecting such an arrangement for the wind propulsion system, a first problem is the way of steering the direction and the speed of the wing element with the associated gondola. It is an object of the invention to provide a steering unit for such a gondola which is capable to improve the steering behavior of the system.

A further problem associated with such arrangement is the weight of the gondola. Generally, it is desired to minimise the weight since (i) the weight of the gondola has to be carried by the wing element thus decreasing the tractive force transferred to the base attachment point and (ii) a larger mass of inertia affects the maneuverability of the wing element negatively. However, forces which have to be transmitted by the gondola are rather high withstanding a dimensional reduction of the support structures within the gondola. It is an object of the invention to provide a steering unit for such a gondola which has an optimized weight in relation to its capability of transferring tractive forces.

Still further, it is generally necessary to control the flight parameters of the wing element from a base control unit which is arranged in close proximity of the base attachment point. Usually, this requires transmission of control signals from the base control unit to the steering unit in the gondola in order to control an actuator in the steering unit. A general problem associated with such a set-up is the risk that the wing element might become uncontrollable if the transmission of the control signals is interrupted. It is a further object of the invention to provide a wind propulsion system which is capable of reducing or even eliminating this risk.

According to a first aspect of the invention, a steering unit as mentioned above is provided, wherein the second attachment means comprise at least one upper fixed attachment point, a left moveable attachment point, a right moveable attachment point, and steering actuator means for varying the distance between the upper fixed attachment point and the left moveable attachment point and for varying the distance between the upper fixed attachment point and the right moveable attachment point.

The steering unit according to the invention provides a sophisticated set-up for steering an aerodynamic wing element attached thereto. The basic concept of zo the steering unit relies on the provision of a fixed, a right moveable and a left moveable attachment point for attaching thereto the tractive lines attached to the aerodynamic wing element. According to the invention, the upper fixed attachment point or a plurality of such upper fixed attachment points are connected to tractive lines which are attached to a central part of the aerodynamic wing element. The left moveable attachment point is arranged to be attached to those tractive lines which are attached to a left-side part of the aerodynamic wing element and the right moveable attachment point is arranged to be arranged to tractive lines attached to a right-side part of the aerodynamic wing element, respectively.

Thus, by shortening the distance between one of the moveable attachment points and the upper fixed attachment point and selectively additionally extending the distance between the other moveable attachment point and the upper fixed attachment point, the geometric shape of the aerodynamic wing element can be altered in order to change the flight direction of the wing element. In particular, the geometric shape of the aerodynamic wing element can be altered from a symmetrical shape, wherein the two moveable attachment points are arranged at a similar distance from an upper fixed attachment point, to an unsymmetrical shape, wherein the aerodynamic wing element is bent on one side in the direction towards the steering unit and selectively additionally bent on the other side in a direction away from the steering unit.

Preferably, the aerodynamic wing element has a cross-sectional shape which is bent as this is known from prior art kites and the curvature of this bending is varied by moving the moveable attachment points.

According to the invention, the moveable attachment points may be arranged outside the mechanical support frame of the steering unit. However, the point of load incident for transferring the tractive forces of the tractive lines attached to the moveable attachment points is preferably arranged within the support frame.

According to a first preferred embodiment, the steering actuator means comprise an actuator for selectively driving a belt in alternative directions, the first end of the belt providing the left moveable attachment point and the second end of the belt providing the right moveable attachment point. With this preferred embodiment, a simultaneous movement of the left and the right moveable attachment point is achieved when driving the belt in one direction. In detail, the distance between an upper fixed attachment point and one of the moveable attachment points is increased whereas the distance to the other one of the attachment points is decreased.

This embodiment may be further improved in that the steering actuator means comprise a driven wheel rotatably fixed to the mechanical support frame and a belt, which is at least partially wound around the wheel, the first end of the belt providing the left moveable attachment point and the second end of the belt, providing the right moveable attachment point. According to this preferred embodiment, the driven wheel serves as point of load incident for the tractive forces acting on the moveable attachment points and these tractive forces are transmitted via rotational bearings of the wheel into the mechanical support frame. The wheel may be driven by an electric motor whose speed of rotation is preferably transferred via a reduction gear to the wheel, thereby enhancing the torque acting on the wheel. The reduction gear may be selected from a planetary gear, a harmonic drive gear, a sumitomo gear or a spinea gear.

Other solutions for actuating the driven wheel may be realized, e.g. a lever connected to the wheel and being eccentrically actuated by a linear actuator.

In particular, it is preferred that the driven wheel is a toothed wheel and the belt is toothed to be matingly received by the wheel. This assures a safe transmission of the rotation of the wheel into a movement of the moveable attachment points.

According to an alternative solution, the steering actuator means comprise a first actuator attached to the support frame and adapted for varying the distance between the upper fixed attachment point and the left moveable attachment point and a second actuator attached to the support frame and adapted for varying the distance between the upper fixed attachment point and the right moveable attachment point. The first and second actuator may be a pneumatic or hydraulic cylinder which first end is attached to the support frame and which second end provides the left and the right moveable attachment point, respectively.

According to another preferred embodiment, the support frame comprises at least one, preferably two or more support plates.

Further, the support frame may preferably comprise two or more support plates arranged at a distance from each other and sandwiching the at least one upper fixed attachment point and the first attachment means. With this embodiment, a structure of the support frame is realized which allows for a light-weight construction and safe transmission of the tractive forces acting onto the support frame. The support plates may be manufactured from appropriate materials like light-metal alloys, fiber-reinforced polymers or the like. In particular, the two support plates may extend from the first attachment means to the upper fixed attachment point(s).

According to a further preferred embodiment, the points of load incidence of the first fixed attachment means and the second attachment means are connected by tensional fiber rovings for transferring the tractive forces. This preferred embodiment relies on the conclusion, that the main forces acting between the first fixed attachment means and the second attachment means are tensional forces and thus, a light-weight structure of the steering unit may preferably be realized by connecting these attachment means with a structure which is particularly adapted for transmitting such tensional forces. According to the preferred embodiment, fiber rovings are used for transferring the tractive forces. The fiber rovings may be selected from glass fibers, carbon fibers, and other fibers well suited for the intended purpose. According to the embodiment, a number of fibers is used to provide a roving. The fibers may be arranged parallel in the roving and may have a kind of connection to each other, e.g. by a matrix material or a mechanical interaction like a twisting, interlacing or interweaving of the fibers.

Further, it is preferred that the support frame comprises at least two support plates arranged at a distance from each other and the first fixed attachment means and the upper fixed attachment point are rigid rods extending from one of the support plates to the other and being connected by tensional fiber rovings for transferring the tractive forces. This embodiment is particularly preferred because it allows for a light-weight structure of the steering unit without giving up relevant mechnical properties of the unit. According to this embodiment, the tensional fiber rovings might be integrated into the support plates or might be arranged at a distance from the support plates. The rods are preferably structurally secured within the support plates whereas the tractional forces between the rods are transferred mainly via the fiber rovings, thus avoiding heavy loads acting on the support plates in case of a separate arrangement of the fiber rovings from these plates.

In particular, it is preferred that the tensional rovings comprise a first set of fiber rovings adjacent to a first one of the support plates and a second set of rovings adjacent to the other one of the support plates. By this, the rods are secured close to their ends fixed within the support plates by the set of fiber roving and thus, a sandwich construction is realized, wherein the middle part of the rods may serve as attachment point and the end regions of the rods are circumscribed by the fiber rovings for transmitting the tractive forces and fixed within the support plates for defining the geometrical arrangement.

Finally, the fixation of the attachment points and attachment means can be furthey improved in that a left and a right upper fixed attachment point are provided and these upper fixed attachment points and the first attachment means are cylindrical rods extending from a first support plate to a second support plate arranged parallel to the first support plate and wherein the cylindrical rods are connected by tensional rovings which are at least partially wound around the rods and which comprise a first fiber roving extending from the rod for the left second fixed attachment point to the rod of the first attachment means, a second fiber roving extending from the rod for the right second fixed attachment point to the rod of the first attachment means, a third fiber roving extending from a point of load incidence for the moveable attachment points to the rod of the first attachment means for transferring the tractive forces. This set-up of the steering unit provides a total of five attachment points, wherein two of the attachment points for the tractive lines are moveable and arranged on the sides of the steering unit and two attachment points for the tractive lines are fixed and arranged in a central part with respect to the moveable attachment points. The moveable attachment point transfers the tractive forces to at least one point of load incident which is attached to the support plates. By this, a total of at least four attachment points is provided within the steering unit and the tractive forces of the two fixed attachment points and the point of load incident are transferred to the first attachment means. According to the embodiment, this transfer of tractive forces is achieved via separate fiber rovings extending from each of the attachment points or point of load incident, respectively, to the first attachment means. It is important to notice that the three fiber roving may be provided by one single fiber roving which is wound around the rods to provide for single fiber rovings extending between the single rods and the attachment means. Additional fiber rovings may be provided between single rods to improve the stiffness of the whole structure.

According to another preferred embodiment at least one of the moveable attachment points and/or the first attachment means is coupled to the support frame via a load measurement cell. This embodiment allows to detect the tractive forces acting via the respective tractive lines onto the moveable attachment points and/or the tractive forces acting via the first attachment means onto the tractive cable. It is of particular advantage to detect these forces close to the steering unit because this allows calculation of certain flight conditions of the aerodynamic wing element and thus be of high relevance for controlling the flight. Another advantage of this preferred embodiment is the arrangement of the sensor signals within the steering unit. By this, it is not necessary to transmit such sensor signals or respectively calculated values to the steering unit via a signal line or other transmission means, thus avoiding the risk of interruption of the transmission.

The steering unit as described previously or in the introductory portion may be further improved by providing additional moveable attachment means for controlling the lifting force of the aerodynamic wing element are provided which are to be coupled to at least one tractive line attached to the aerodynamic wing element in a region between its leading edge and its trailing edge. Such additional moveable attachment means may be arranged besides the right and left moveable attachment means and serve to control the lifting force of the wing element during the flight. Since a reduced lifting force will usually result in an increase of angle of attack of the wing element, i.e. a lift of the leading edge in relation to the trailing edge, such lifting force control lines may be used for inclination control as well.

The additional moveable attachment means for controlling lifting force of the aerodynamic wing element may preferably comprise a left moveable attachment means and a right moveable attachment means which are to be coupled to at least one tractive line attached to a left region and a right region of the aerodynamic wing element, respectively, in a region between its leading edge and its trailing edge. This allows the individual control of the lifting force in the left and the right wing part of the wing element and thus may be used to improve maneuverability and/or to twist the wing element as a consequence of the change of individual angle of attack.

According to another aspect of the invention, the steering unit as mentioned above or described in the introductory portion of this description may be further improved in that the steering unit comprises an energy storage, a sensor for detecting the orientation and/or rate of turn of the steering unit, the position of the steering unit and/or at least one flight parameter of the steering unit, and a controller for controlling the flight direction of an aerodynamic wing element attached to the steering unit, the controller being connected to the sensor(s) and the energy storage and being capable of controlling an actuator for changing the flight direction of the aerodynamic wing element based on the sensor signals. With a such equipped steering unit it is possible to provide an improved control of the aerodynamic wing element wherein at least a part of the process steps required for calculating the controller signals for the actuator are performed within the steering unit thus avoiding the need to transfer large amounts of signals to a main controller unit arranged at a ground station and vice versa.

This preferred embodiment can be further improved in that the controller is capable of controlling the actuator for changing the flight direction of the aerodynamic wing element without input from outside the steering unit. In particular when controlling large scale wing elements using the steering unit according to the invention it is important to ensure that even in the case of failure, wherein the transmission of signals from a ground control station to the steering unit is interrupted or disordered, some basic control functions can be maintained by the steering unit without input from outside, e.g. from the ground control station. Thus, the concept of this improvement is to provide a certain amount of selfsufficiency of the steering unit in order to allow for an autarkic control of the aerodynamic wing element by the steering unit for at least a certain time period in case that breakdown of energy transfer and/or signal transmission between the ground station and the steering unit occurs. The controller of the steering unit can thus switch into an emergency failure mode wherein it is at least avoided that the aerodynamic wing element becomes uncontrollable.

It is further preferred that the energy storage comprises an electric, preferably rechargeable battery, a capacitor and/or an air accumulator. These energy storages are particularly well-suited for storing energy with low weight-components and for providing the energy in the form required for the actuating drive.

Thereby it is further preferred that the controller comprises a logic unit programmed for controlling the actuator in such a way, that the aerodynamic wing element is always kept above a minimum altitude. This will allow to safely maintain a certain altitude of the aerodynamic wing element and might even make it possible to control the aerodynamic wing element in such a way that the same or only slightly diminished operability is achieved, thus further providing significant tractive forces in the tractive cable to provide significant energy transfer to the ground station.

The logic unit may preferably be programmed for keeping the aerodynamic wing element at a fixed altitude or within a fixed altitude range, for directing the aerodynamic wing element along a predetermined closed loop flight path, and/or for keeping the aerodynamic wing element along a straight flight path extending horizontally. The logic unit may be programmed only according to one of these alternatives or two or all of these alternatives may be programmed so that, depending on flight conditions an appropriate emergency program may be selected which fits the present situation. In particular when the steering unit is used to control an aerodynamic wind propulsion system for towing watercraft the flight along a straight flight path may be preferred in order to allow for continuous operation and traction of the wind propulsion system. In this case, the straight flight path will preferably correspond to the course of the watercraft before the emergency situation arose and the position of the aerodynamic wind element is adjusted for minimal force in the towing line and minimal steering force: this position will normally be the zenith position.

It is further preferred, that the controller is connected to at least one sensor detecting an angular position of the steering unit in relation to the direction of gravity and is programmed to maintain a fixed angular orientation or an angular orientation range or a programmed sequence of angular orientations in at least one plane, preferably more planes and in particular three planes oriented orthogonal to each other in relation to the direction of gravity. This preferred embodiment uses a typical property of aerodynamic wing elements like kites, namely that in case of wind directions oriented in a perpendicular plane to the direction of gravity (i.e. horizontal) the flight direction and the direction of the tractive forces exerted by the wing element can be controlled by keeping the wing element in a certain angular orientation with respect to the direction of gravity. This can be achieved by adjusting a respective angular orientation of the steering unit with respect to the direction of gravity. Thus, the controller may preferably be programmed to maintain an angular position or an angular position range with respect to the direction of gravity. This will usually result in a more or less fixed position of the steering unit and the wing element, respectively, with respect to the ground station. In an improved version of this controller a programmed sequence of angular orientations is adjusted consecutively. This allows the aerodynamic wing element to be directed into a certain preferred position and could further be used to direct the aerodynamic wing element along a closed loop flight path like a circle, an ellipsoid or a flight path in the form of a lying eight. Controlling such a sequence of orientations will often provide a safer control of the flight of the wing element because such control is less sensitive to momentary changes of wind speed and wind direction.

It is further preferred that the controller is connected to three gyroscope sensors arranged in three directions orthogonal to each other and three linear acceleration sensors arranged in three directions orthogonal to each other and is programmed to calculate an estimation of the direction of gravity from the signals of these sensors. This embodiment allows a rather precise determination of the direction of gravity even in a steering unit which is exposed permanently changing accelerations.

According to a further aspect of the invention a steering unit as previously described or a steering unit as described in the introduction of the description may be further improved in that the controller is connected to a load cell coupled between the support frame and the first attachment means for measuring the tractive force of the aerodynamic wing element, a load cell coupled between the support frame and the left moveable attachment points for measuring the left steering force, a load cell coupled between the support frame and the right moveable attachment points for measuring the right steering force, a GPS position finder, and/or an anemometer.

This preferred embodiment provides at least one and preferably five important input parameters for controlling the flight of the aerodynamic wing element from within the steering unit without the need to transmit respective sensor signals from outside to the steering unit. This will improve self-sustaining operation of the steering unit in case of temporary breakdown of such signal transmission. In particular, it is preferred that at least two of the load cells and the anemometer are provided to ensure basic control of the aerodynamic wing element.

The invention may further be embodied in an aerodynamic wind propulsion systems, comprising an aerodynamic wing connected via a number of tractive lines attached to the wing at a plurality of attachments points distanced along the width of the wing to a steering unit as described before, wherein a number of most left tractive lines are combined and connected to the left moveable attachment point, a number of central left tractive lines are combined and connected to the left fixed attachment point, a number of central right tractive lines are combined and connected to the right fixed attachment point, and a number of most right tractive lines are combined and connected to the right moveable attachment point.

Such wind propulsion system comprises a steering unit which is integrated in the system and connected to the aerodynamic wing element to provide for the functions of the steering unit as previously described.

The aerodynamic wind propulsion system may be further improved in that the steering unit comprises additional moveable attachment means for controlling lifting force of the aerodynamic wing element which are coupled to at least one, preferably a number of tractive lifting force control lines attached to the aerodynamic wing element in a region between its leading edge and its trailing edge. Such tractive lifting force control lines allow changing the aerodynamic profile of the aerodynamic wing element. By this, the aerodynamic profile may be changed to a less effective profile producing less lifting force, e.g. by pulling the tractive lifting force control lines and thus inducing a downward curvature in the aerodynamic wing element in the region of their attachment points. Such decrease of lifting force will usually result in an increase of the angle of attack of the aerodynamic wing element, i.e. the aerodynamic wing element will lower its trailing edge and lift its leading edge. Viceversa, the lifting force may be increased again by slacking the lifting force control lines and thus restoring the optimum aerodynamic profile for maximum lifting force and restoring horizontal flight attitude of the wing element. Such control of lifting force may be used to lower the lifting force and thus decrease responsiveness of the wing element to interference or changes of wind direction and speed during the starting or landing maneuver.

Preferably, the at least one tractive lifting force control line is attached to the aerodynamic wing element in a distance of one quarter of the length of the aerodynamic wing element behind the leading edge. The region adjacent to one quarter in lengthwise direction behind the leading edge has shown to be most effective for changing lifting force and thus the lifting force control lines are preferably attached in this region.

Further, a number of tractive lifting force control lines are attached to the aerodynamic wing element along its widthwise central region. This improvement provides a reasonable reduction of the number of tractive lifting force control lines. It has been demonstrated that the central region of the aerodynamic wing element is most effective for controlling the lifting force, whereas the side regions have less influence on this. Thus, tractive lifting force control lines attached to the side regions may be omitted for ease of construction.

Still further, the additional moveable attachment means for controlling lifting force of the aerodynamic wing element may preferably comprise a left moveable attachment means and a right moveable attachment means which are coupled to at least one tractive line attached to a left region and one tractive line attached a right region of the aerodynamic wing element, respectively, in a region between its leading edge and its trailing edge. This will allow control of the lifting force of the aerodynamic wing element separately in the left and the right region and thus allow to control flight direction of the wing element and to twist the wing element around its lengthwise axis.

Further, the invention may be embodied in a watercraft connected via a tractive cable to the first attachment means of a steering unit of a wind propulsion system as described above. In this respect, reference is made to the international applications mentioned in the introduction of this description describing such systems for towing watercraft.

According to a further aspect of the invention a method for controlling an aerodynamic wind propulsion system is provided wherein steering signals are transmitted from a base control unit arranged at a first lower end of a tractive cable to a remote control unit mounted in a steering unit fixed to an upper second end of the tractive cable and attached to an aerodynamic wing element, for controlling the flight direction of the aerodynamic wing element and the steering unit, characterized in that the flight direction is controlled by the remote control unit in case that the remote control unit does not receive steering signals for a predetermined period of time.

This method allows for exact control of the flight of the aerodynamic wing element in regular operation mode by transmitting respective control signals from the base control unit and avoids that the wing element becomes uncontrollable in case that the transmission of these signals is interrupted or disordered by controlling the wing element in such cases out of the remote control unit which is directly arranged within the steering unit. In such cases the remote control unit may continue the control on the basis of values calculated by extrapolation of the previously transmitted steering signals or may switch into an emergency control mode wherein a pre-programmed routine is followed to avoid the wing element becoming uncontrollable.

In a first improved embodiment it is preferred that the remote control unit holds the steering unit at a certain angular orientation or angular orientation range in relation to the direction of gravity in at least one plane, preferably more planes and in particular three planes oriented orthogonal to each other. To this extent it is referred to the previous description of the respective embodiment of the steering unit providing the capability to control the wing element with respect to angular orientation in relation to the direction of gravity.

Further, it is preferred that the remote control unit sequentially directs the steering unit according to a closed loop sequence of certain angular orientations in relation to the direction of gravity in at least one plane, preferably more planes and in particular three planes oriented orthogonally to each other.

Finally, it is preferred that in case of an interruption of transmission of steering signals the remote control unit extrapolates a sequence of the last steering signals received from the base control unit and calculates a sequence of future steering signals from this extrapolation.

Preferred embodiments of the invention will be described with reference to the accompanying figures. In the figures,

DETAILED DESCRIPTION

Figure 2:
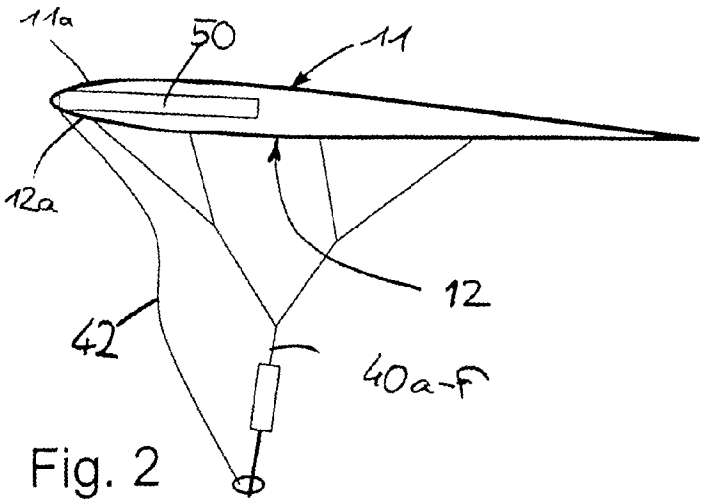
FIG. 2 depicts a side view of the wing element and steering unit according to FIG. 1.
Figure 1:
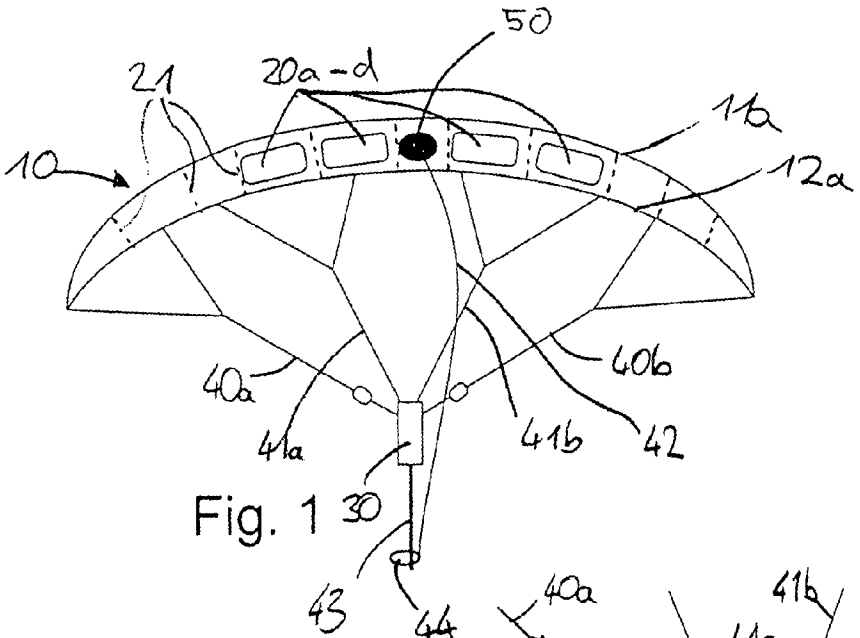
FIG. 1 depicts a frontal view of an aerodynamic wing element with a steering unit according to the invention attached thereto.

Referring to FIGS. 1 and 2 an aerodynamic wing element according to the invention may be shaped like a kite 10 comprising an upper layer 11 and a lower layer 12. In the frontal view according to FIG. 1 four openings 20*a-d* are visible in the leading edge 11*a*, 12*a*. These openings ventilate the inner space between the upper and lower layer 11, 12. The openings are arranged beside the horizontal longitudinal axis of the kite. In the lateral area between the leading edges 11*a*, 12*a* no openings are present.

The upper and lower layer are connected via a plurality of ribs 21 shown in dashed lines in FIG. 1. The assembly of upper layer, lower layer and the plurality of ribs provides a flexible wing element. This wing element is attached to a steering unit 30 via a plurality of tractive lines. Basically, starting from a large number of lines attached to the wing element these lines are merged to a reduced number of lines in a plurality of merging steps (for the sake of clarity only one merging step of two such tractive lines into one common tractive line is shown in FIG. 1) and finally the plurality of tractive lines attached to the wing element is reduced to a total number of four tractive lines attached to the steering unit 30.

These four tractive lines consist of two steering tractive lines 40*a, b* and two fixed tractive lines 41*a, b*. As can be seen in the figure, the fixed tractive lines 41*a, b* are connected to the central region of the kite whereas the steering tractive lines 40*a, b* are connected to the two lateral regions of the kite, namely the left steering tractive line 40*a* to the left lateral region and the right steering tractive line 40*b* to the right lateral region.

As can be seen from FIG. 2, the wing element is attached to a number of tractive lines in its longitudinal direction in the same manner as shown in FIG. 1 for its width direction. The attachment points of the tractive lines are distributed along the wing element in its longitudinal direction and are merged to the final four tractive lines connected to the steering unit in the same way as previously described for those tractive lines distributed along the width direction of the wing element.

A rigid kite stick 50 is attached to the kite along its longitudinal middle axis between the upper and lower layer 11, 12. The kite stick 50 extends along approximately one third of the total length of the kite. A guiding line 42 is guided at the kite stick 50 serving for starting and docking manoeuvres of the kite.

A tractive cable 43 is attached to the steering unit 30 to connect the steering unit with a watercraft which is to be towed by the kite 10. The guiding line 42 is attached slidingly and detachable via a ring element 44 along the tractive cable 43.

Figure 3:
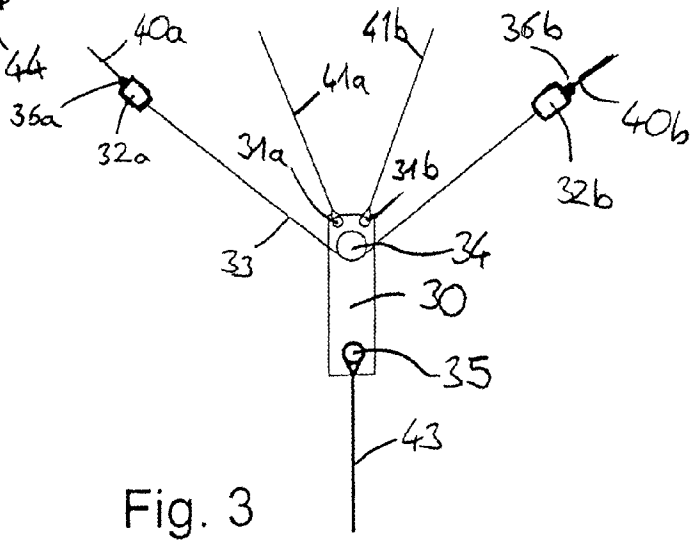
FIG. 3 depicts a detail of the steering unit having attached four tractive lines for connecting with the wing element and one tractive cable for connecting with a base station.

As can be seen from the detailed view of FIG. 3, the steering unit 30 comprises two fixed upper attachment points 31*a, b* at which the fixed tractive lines 41*a, b* are attached to.

Each of the steering tractive lines 40*a, b* is coupled with a respective moveable attachment point 36*a, b* at a first end of load cells 32*a, b*. The second end of the load cells 32*a, b* is coupled with a gear belt 33, connecting the two load cells 32*a, b*. The gear belt 33 is wound around a gear wheel 34*a* within the steering unit 30 and thus deflected. Rotation of the gear wheel 34*a* will vary the distance between the moveable attachment points 36*a, b* at the load cells 32*a, b* and the gear wheel 34 or the upper fixed attachment points 31*a, b*. By this, the curvature of the kite 10 can be changed in that the distance between a first one of the load cells 32*a, b* to the upper fixed attachment points 31*a, b* is increased and at the same time the distance of the other one of the load cells 32*a, b* to these upper fixed attachment points 31*a, b* is decreased. This will result in a change of flight direction of the kite.

The tractive cable 43 is attached to the steering unit at a third fixed attachment point 35.

Figure 4:
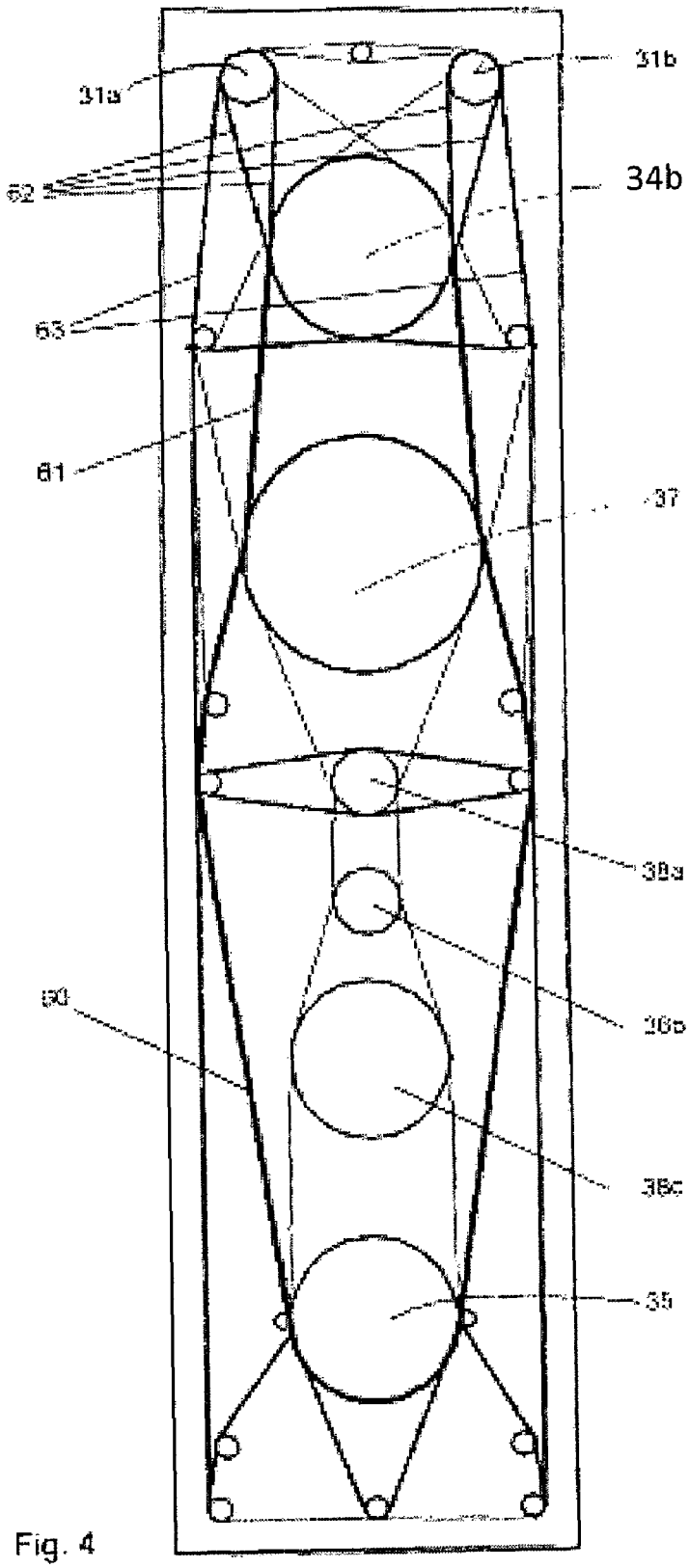
FIG. 4 depicts a schematic drawing of the points of load incident of the steering unit and their connection via tensional rovings.

Referring to FIG. 4, the mechanical set-up for transferring the tractive forces from the upper fixed attachment points 31*a*, 31*b*, the support 34*b* for the gear wheel 34*a* to the lower fixed attachment point 35 is shown. Further, a recess provided by a tube 37 for placing therein a motor and a gear for actuating the gear wheel is provided between the gear wheel 34 and the lower fixed attachment point 35. Between the recess provided by the tube 37 and the lower fixed attachment point 35 there are a number of tubes providing recesses 38*a-c* for arranging power and data cables and an on/off switch therein are provided.

The points of load incidence and the attachment points are coupled via one fiber roving wound around them and being such divided in a plurality of sections.

A first main fiber roving section 60 is wound around the tube 37 and the lower fixed attachment point to provide a rigid and strong connection between them. A further main fiber roving section 61 is wound around the tube 37 and the support 34*b* for the gear wheel 34*a*. Finally, a third main fiber roving section 62 is wound around the upper left fixed attachment point 31*a*, then wound around the support 34*b* and by this redirected to be wound around the upper right fixed attachment point 31*b*.

Further, a number of strong fiber rovings sections 63 are provided to directly couple the upper left and right fixed attachment points 31*a, b* to the lower fixed attachment point.

For increasing stiffness of the whole mechanical set-up, a number of secondary fiber roving sections are wound around the tubes, attachment points and supports of the steering unit.

Figure 5:
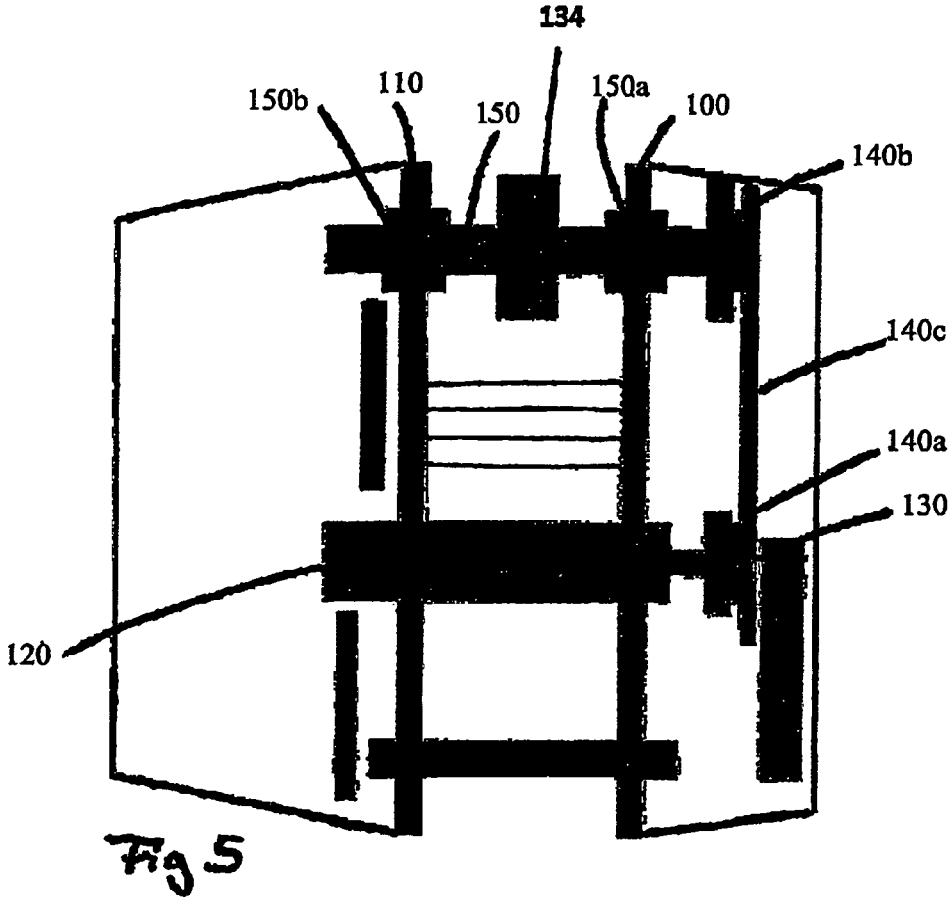
FIG. 5 depicts a schematic side view of the arrangement of the components within a steering unit according to the invention.

Referring now to FIG. 5, the set up of the steering unit is shown. The steering unit comprises a first support plate 100 and a second support plate 110. The first and the second support plate 100, 110 are arranged parallel to each other in a distance leaving enough space for arranging the fixed attachment points between them. An electric motor 120 is arranged with its longitudinal axis perpendicular to the plane of the support plates 100, 110 and extends through both support plates. The electric motor 120 is coupled with a reduction gear 130 and a further belt reduction gear 140*a-c* comprising a first gear wheel 140*a*, a second gear wheel 140*b* and a gear belt 140*c* connecting these two gear wheels 140*a, b*.

The second gear wheel 140*b* is mounted to a shaft 150 which is arranged parallel to the longitudinal axis of the electric motor 120 and is rotatably fixed within the two support plates 100, 110 via a first rotational bearing 150*a* and a second rotational bearing 150*b*, respectively.

Between the two rotational bearings 150*a, b* a gear wheel 134 is fixed to the shaft 150. The gear wheel matingly receives a gear belt (not shown) which carries the left and right moveable attachment points at its respective ends as shown in FIG. 3.

The steering unit shown in FIG. 5 further comprises a controller 160 connected to the electric motor 120 to provide steering signals to the motor 120. Further, three gyroscope sensors arranged in three directions orthogonal to each other and three linear acceleration sensors arranged in three directions orthogonal to each other are integrated into the steering unit and connected to the controller to provide the controller with information about the present actual acceleration of the steering unit with respect to three orthogonal axis and three orthogonal directions.

The controller is adapted to calculate the direction of gravity from these sensor signals and to provide the electric motor 120 with steering signals to follow a preprogrammed sequence of angular orientations of the steering unit with respect to the direction of gravity.

The invention claimed is:

1. Steering unit for a wind propulsion system, the steering unit comprising:

a first fixed attachment means (35) configured to secure a first end of a tractive cable (43), wherein a second end of the tractive cable is secured to a device or a vehicle to which a tractive force shall be transferred;

a second attachment means (31*a, b*, 36*a, b*, 33, 34) configured to attach a number of tractive lines (40*a, b*, 41*a, b*), a second end of each of the tractive lines being secured to an aerodynamic wing element (11*a*, 12*a*, 21); and a mechanical support frame (100, 110) connecting the first attachment means to the second attachment means for transferring a tractive force, characterized in that the second attachment means comprise at least one upper fixed attachment point (31*a, b*), a left moveable attachment point (36*a*), a right moveable attachment point (36*b*), and steering actuator means (33, 34, 120, 130, 140*a-c*) configured to vary the distance between the upper fixed attachment point and the left moveable attachment point and for varying the distance between the upper fixed attachment point and the right moveable attachment point.

2. Steering unit according to claim 1, wherein the steering actuator means comprise an actuator (120, 34) for selectively driving a belt (33) in alternative directions, the first end of the belt providing the left moveable attachment point and the second end of the belt providing the right moveable attachment point.

3. Steering unit according to claim 2, wherein the steering actuator means comprise a driven wheel (34) rotatably fixed to the mechanical support frame and the belt (33), which is at least partially wound around the wheel, a first end of the belt providing the left moveable attachment point and a second end of the belt providing the right moveable attachment point.

4. Steering unit according to claim 3, wherein the driven wheel is a toothed wheel and the belt is toothed to be matingly received by the wheel.

5. Steering unit according to claim 1, wherein the steering actuator means comprise a first actuator attached to the support frame and adapted for varying the distance between the upper fixed attachment point and the left moveable attachment point and a second actuator attached to the support frame and adapted for varying the distance between the upper fixed attachment point and the right moveable attachment point.

6. Steering unit according to claim 5, wherein the first and second actuator each comprise a pneumatic or hydraulic cylinder, which first end is attached to the support frame and which second end provides the left and the right moveable attachment point, respectively.

7. Steering unit according to claim 1, wherein the support frame comprises two or more support plates (100, 110).

8. Steering unit according to claim 1, wherein the support frame comprises at least two support plates (100, 110) arranged at a distance from each other and sandwiching the at least one upper fixed attachment point and the first attachment means.

9. Steering unit according to claim 1, wherein points of load incidence of the first fixed attachment means and the second attachment means are connected by tensional fiber rovings for transferring the tractive forces.

10. Steering unit according to claim 1, wherein the support frame comprises at least two support plates arranged at a distance from each other and the first fixed attachment means and the at least one upper fixed attachment point of the second attachment means comprise rigid rods extending from one of the support plates to the other support plate and being connected by tensional fiber rovings for transferring the tractive forces.

11. Steering unit according to claim 10, wherein the tensional rovings comprise a first set of fiber rovings adjacent to a first one of the support plates and a second set of rovings adjacent to the other one of the support plates.

12. Steering unit according to claim 1, wherein a left (31*a*) and a right (31*b*) upper fixed attachment point is provided and these upper fixed attachment points and the first fixed attachment means are rods extending from a first support plate to a second support plate arranged parallel to the first support plate and wherein the rods are connected by tensional rovings which are at least partially wound around the rods and which comprise a first fiber roving extending from the rod for the left second fixed attachment point to the rod of the first fixed attachment means, a second fiber roving extending from the rod for the right second fixed attachment point to the rod of the first fixed attachment means, a third fiber roving extending from a point of load incidence for the moveable attachment points to the rod of the first fixed attachment means for transferring the tractive forces.

13. Steering unit according to claim 1, wherein at least one of the moveable attachment points or the first fixed attachment means is coupled to the support frame via a load measurement cell.

14. Steering unit according to claim 1, wherein additional moveable attachment means configured to control a lifting force of the aerodynamic wing element are provided which are to be coupled to at least one tractive line attached to the aerodynamic wing element in a region between a leading edge and a trailing edge of the aerodynamic wing element.

15. Steering unit according to claim 1, wherein the the left moveable attachment point and the right moveable attachment point are coupled to at least one tractive line attached to a left region and a right region of the aerodynamic wing element, respectively, in a region between a leading edge and a trailing edge of the aerodynamic wing element.

16. Steering unit according to claim 1, characterized in that the steering unit comprises an energy storage, a sensor for detecting the orientation or rate of turn of the steering unit, a position of the steering unit or at least one flight parameter of the steering unit, and a controller for controlling the flight direction of an aerodynamic wing element attached to the steering unit, the controller being connected to the sensor(s) and the energy storage and being capable of controlling an actuator for changing a flight direction of the aerodynamic wing element based on the sensor signals.

17. Steering unit according to claim 16, characterized in that the controller is capable of controlling the actuator for changing the flight direction of the aerodynamic wing element without input from outside the steering unit.

18. Steering unit according to claim 17, wherein the controller comprises a logic unit programmed for controlling the actuator in such a way, that the aerodynamic wing element is always kept above a minimum altitude.

19. Steering unit according to claim 16 or 18, wherein the energy storage comprises an electric rechargeable battery, a capacitor or an air accumulator.

20. Steering unit according to claim 16, wherein the controller comprises a logic unit that is programmed for keeping the aerodynamic wing element at a fixed altitude or within a fixed altitude range, for directing the aerodynamic wing element along a predetermined closed loop flight path, or for keeping the aerodynamic wing element along a straight flight path extending horizontally.

21. Steering unit according to claim 16, wherein the controller is connected to at least one sensor detecting an angular position of the steering unit in relation to the direction of gravity and is programmed to maintain a fixed angular orientation, an angular orientation range, or a programmed sequence of angular orientations in at least one plane, preferably more planes and in particular three planes oriented orthogonal to each other in relation to the direction of gravity.

22. Steering unit according to claim 16, wherein the controller is connected to three gyroscope sensors arranged in three directions orthogonal to each other and three linear acceleration sensors arranged in three directions orthogonal to each other and is programmed to calculate an estimation of the direction of gravity from the signals of these sensors.

23. Steering unit according to claim 16, further characterized in that the controller is connected to a load cell coupled between the support frame and the first attachment means for measuring a tractive force of the aerodynamic wing element, a load cell coupled between the support frame and the left moveable attachment points for measuring a left steering force, a load cell coupled between the support frame and the right moveable attachment points for measuring a right steering force, a GPS position finder, or an anemometer.

* * * * *